United States Patent [19]

Tanaka et al.

[11] Patent Number: 4,823,908

[45] Date of Patent: Apr. 25, 1989

[54] DIRECTIONAL LOUDSPEAKER SYSTEM

[75] Inventors: Tsuneo Tanaka, Amagasaki; Mikio Iwasa, Katano; Youichi Kimura, Suita; Akira Nakamura, Minoo, all of Japan

[73] Assignee: Matsushita Electric Industrial Co., Ltd., Osaka, Japan

[21] Appl. No.: 862,349

[22] PCT Filed: Aug. 26, 1985

[86] PCT No.: PCT/JP85/00469

§ 371 Date: Apr. 28, 1986

§ 102(e) Date: Apr. 28, 1986

[87] PCT Pub. No.: WO86/01670

PCT Pub. Date: Mar. 13, 1986

[30] Foreign Application Priority Data

| | | | |
|---|---|---|---|
| Aug. 28, 1984 | [JP] | Japan | 59-179743 |
| Nov. 20, 1984 | [JP] | Japan | 59-245136 |
| May 2, 1985 | [JP] | Japan | 60-94702 |
| May 20, 1985 | [JP] | Japan | 60-107505 |
| Jul. 4, 1985 | [JP] | Japan | 60-147555 |
| Aug. 26, 1985 | [JP] | Japan | 59-179742 |

[51] Int. Cl.[4] ..... E04B 1/99

[52] U.S. Cl. ..... 181/175; 181/30; 181/148; 181/151; 181/155; 381/158; 381/160

[58] Field of Search ..... 181/175, 176, 177, 30, 181/148, 151, 155; 381/82, 83, 91, 158, 160; 179/110 A

[56] References Cited

U.S. PATENT DOCUMENTS

| | | | |
|---|---|---|---|
| 2,064,911 | 12/1936 | Hayes | 181/175 X |
| 3,908,095 | 9/1975 | Jinsenji | 181/176 X |
| 4,233,477 | 11/1980 | Rice et al. | 179/110 A |

*Primary Examiner*—Benjamin R. Fuller

*Attorney, Agent, or Firm*—Wenderoth, Lind & Ponack

[57] ABSTRACT

A parametric loudspeaker utilizes nonlinearity of air relative to ultrasonic waves for producing an audio frequency having super directivity, and to thus provide a limited listening area public address system subject to a large listening area by safeguarding listeners by the provision of a framework for intercepting powerful ultrasonic waves and an acoustic filter. The depth and energy consumption of the parametric loudspeaker are reduced by the use of a reflective plate. Arbitrary directivity is obtained by the provision of a mechanism to move an ultrasonic wave radiator or the reflective plate. The parametric loudspeaker and any other loudspeaker may be combined.

21 Claims, 27 Drawing Sheets

DIRECTIONAL LOUDSPEAKER SYSTEM

FIELD OF TECHNOLOGY

The present invention relates to a parametric loudspeaker system utilizing the nonlinearity of air relative to an ultrasonic wave for reproducing audible sounds having a super directivity and is intended to provide, in the first place, a method for intercepting powerful ultrasonic waves, secondly a method for minimizing the depth by the use of a reflective plate, thirdly a method for obtaining an arbitrary directivity by providing an ultrasonic wave radiator or the reflective plate with a movable mechanism, and fourthly a directional loudspeaker system wherein a parametric loudspeaker is combined with any other loudspeaker.

BACKGROUND ART

In the field of public address systems, one of the most important problems is to freely control the directivity of sound. In particular, as noise pollution has recently become a social problem, demands have increased for a direction variable, or direction controlled, loudspeaker system. However, since the wavelength of a sound wave is extremely long as compared with light, it has been difficult to realize a loudspeaker system having super directivity like a spot-light while a wide directivity can be readily realized.

Hitherto, a horn loudspeaker has been mainly used to sharpen the directivity, but there is a drawback in that a gigantic horn is necessitated to sharpen the directivity to low frequencies such as the voice band.

On the other hand, a loudspeaker system utilizing the nonlinear interaction between finite amplitude ultrasonic waves by the nonlinearity of a medium (parametric loud-speaker) has recently drawn attention because it can give super directivity as compared with the conventional system (Japanese Laid-open Patent Publication No. 58-119293). However, chiefly for the following reasons, the parametric loudspeaker has not long been used in practice.

(1) Because of a low conversion efficiency, an extremely powerful ultrasonic wave is required to reproduce an audible sound of practically acceptable level, and when listeners are subjected directly to this powerful ultrasonic sound, harm such as hearing impairment will occur.

(2) Since a space which is called a parametric array is required to reproduce an audible sound from the ultrasonic wave, the loudspeaker system is increased in length and the space for installation is limited.

(3) Because of the low conversion efficiency, the use of a very bulky and expensive ultrasonic wave radiator is required in order to cover a large listening area.

(4) As is the case with the conventional loudspeaker, the directivity cannot be freely controlled.

In order to control the directivity of a loudspeaker, a loudspeaker having super directivity is necessary in the first place. This is because, if the super directivity is realized, any directional characteristic can be realized by combination therewith. Hitherto, as a loudspeaker having super directivity, a horn loudspeaker has been used chiefly. This is, as shown in FIG. 1, a version wherein an acoustic tube 2 having its cross-sectional area varying gradually, which is called a horn, is fitted frontwardly to a dynamic electroacoustic transducer 1 which is called a driver. However, the directional characteristic of the horn loudspeaker depends mainly on the shape of a horn side wall 3 and the length of the horn, and there is a problem in that an extremely long horn is necessary in order to have super directivity at a low frequency. It is to be noted that 3*a* represents a movable side wall.

On the other hand, the parametric loudspeaker, which is a sound reproducing system utilizing a nonlinear effect, is capable of realizing super directivity comparable to the conventional loudspeaker utilizing a linear phenomenon, even though it has a radiating surface area of a size equal to one tenth of that of the conventional loudspeaker. Hereinafter, the fundamental principle of the parametric loudspeaker will be described with reference to FIG. 2.

In FIG. 2, 4 represents a source of an audio signal to be reproduced, 5 represents a high frequency oscillator used in a carrier wave, 6 represents a modulator, 7 represents a power amplifier, and 8 represents an ultrasonic wave radiator. The audio signal source 4 and an output signal from the high frequency oscillator 5 for the carrier wave are inputted to the modulator 6. An output signal from the modulator is amplified by the power amplifier 7, inputted to the ultrasonic radiator 8, and radiated in the air in the form of an ultrasonic wave modulated by the audio signal.

Where a sound wave has a high amplitude and is considered having a finite amplitude, the original waveform is distorted by the nonlinearity of a medium (e.g. air) and numerous frequency components not included in the original waveform tend to be produced as it propagates. The parametric loudspeaker utilizes one of the nonlinear effects which is called a parametric interaction. When two finite amplitude sound waves having slightly different frequencies are radiated simultaneously in the medium, a sound wave having a frequency equal to the sum and difference of the two waves is produced by the nonlinear interaction (parametric interaction) of the two sound waves. Accordingly, if the original two sound waves are ultrasonic waves and the difference therebetween is so selected as to be an audio frequency, an audible sound is generated by the parametric interaction.

Assuming that the ultrasonic wave amplitude-modulated by the audio signal is radiated in the air, an ultrasonic sound field (parametric array) having a spectrum such as shown in the right-hand portion of FIG. 3 can be formed. As a result, by the parametric interaction between the carrier wave and upper and lower sideband waves, the original audio signal having the difference frequency thereof is produced in the air. The audío signal so produced reflects the directivity of the ultrasonic wave. The ultrasonic wave has a wavelength shorter than the audio frequency and is effective to provide a sound source having super directivity. Accordingly, by this method, it is possible to realize a low frequency sound source having super directivity. Moreover, the modulated ultrasonic wave radiated from the ultrasonic wave radiator is referred to as a primary wave, and an audio frequency resulting from the parametric interaction of the primary wave is referred to as a secondary wave.

However, since the parametric loudspeaker is a system utilizing the nonlinearity of a medium for producing the secondary wave, which is at the audio frequency, from the primary wave, the conversion efficiency is extremely low. By way of example, in order to obtain the secondary wave sound pressure level of about 90 dB which is a practically acceptable level, a high primary wave sound pressure of 140 dB or higher is necessitated. It is known that, when listeners are radiated by such a powerful ultrasonic wave, they will suffer from adverse effects such as, for example, hearing impairment, dizziness or headache. Accordingly, in order to put the parametric loudspeaker to practical use, it is necessary to install between the ultrasonic wave radiator 8 and a listener 9 a low bandpass acoustic filter 10 operable to intercept the primary wave, but to allow the passage of only the secondary wave as shown in FIG. 2.

What has hitherto been used as the acoustic filter consists of a so-called sound absorbing material such as fabric, felt or glass wool, which relies on its peculiar characteristic to absorb sounds of a particular band, or a cavity type muffler having a structure effective to attenuate only a particular frequency, but any one of the conventional sound absorbing material and the cavity type muffler is not suited for use as an acoustic filter for the parametric loudspeaker because the conventional sound absorbing material is manufactured with a view to attenuating only the audio frequency and because the cavity type muffler is difficult to design for an ultrasonic wave band.

In addition, in order to produce efficiently the secondary wave from the primary wave, the distance of propagation of the primary wave must be long. While the sound field in which the parametric interaction takes place is regarded as a sort of vertical array and is therefore called a parametric array, the length for which the parametric array is sufficiently completed is about 8 m at, for example, 40 kHz, although it varies with the frequency of the carrier wave, sound pressure level of the primary wave and so on. Therefore, where the acoustic filter is installed in front thereof, since the length of the parametric array (hereinafter referred to as array length) is shortened, there is a problem in that the sound pressure level of the secondary wave being reproduced is lowered along with a deterioration in directivity. Moreover, since a space for demodulation which is called the parametric array is in principle required for the production of the secondary wave, there is also a problem in that the depth of the loudspeaker tends to be lengthened and the space for installation is limited.

Yet, when the ultrasonic wave radiator 8 is secured to the ceiling of a building as shown in FIG. 4, even though the acoustic filter 10 is effective to completely intercept the ultrasonic wave, a listener **9*b* distant from the loudspeaker will be directly showered with the ultrasonic wave radiated from the ultrasonic wave radiator 8 and a listener 9*a*** immediately below the acoustic filter will also be radiated with the ultrasonic wave which has been reflected from a wall or the like in the surroundings. Even though the ultrasonic wave has a super directivity, the level of the ultrasonic wave scattering in this manner within a room attains a level that cannot be considered sufficiently safe.

Furthermore, if not only is the directivity rendered super, but if also the directivity can be freely controlled should the necessity arise, advantages can be achieved. However, since the directivity of the loudspeaker, regardless of whether a direct radiator-type or a horn type, depends on the shape of the horn and the size of a vibrating plate, it has been difficult to control it freely. What has been hitherto used is a method in which the shape of the horn side wall is changed or a diffuser plate is provided. By way of example, if the angle of the movable side wall **3*a* which is a portion of the horn side wall is made adjustable as shown in FIG. 1, it is possible to achieve a narrow directivity when the movable side wall 3*a*** is held at a position A, and a wide directivity when it is held at a position B. However, the range over which the directivity can be changed with this method is relatively narrow, and there is a problem in that the limit of the narrow directivity is particularly fixed by the shape of the horn side wall and the length of the horn.

SUMMARY OF THE INVENTION

The present invention has been devised with a view to overcoming these problems and is intended to provide a loudspeaker system having an arbitrary directivity by resolving the above mentioned problems, and contemplates the practical use of a parametric loudspeaker.

The fundamental structure of the parametric loudspeaker comprises a modulator for modulating a high frequency at an audio frequency, and an ultrasonic wave radiator for radiating an ultrasonic wave of finite amplitude level into a medium, and this invention can take any one of numerous constructions to achieve respective of the following objects.

A primary object of the present invention is to safeguard the listeners by intercepting the ultrasonic wave radiated from the ultrasonic wave radiator in the parametric loudspeaker and, for this purpose, a space necessary to produce the audio frequency from the ultrasonic wave is enclosed by a framework or enclosure to avoid any leakage of the ultrasonic wave while at least a portion of the framework is provided with an acoustic filter capable of permitting the passage of only the audio frequency.

A second object of the present invention is to provide a structure and a material suited for the acoustic filter and, for this purpose, it is constructed with a laminated structure of soft poly-urethane foam and thin plastics films, etc., and a stack of thin plastics films with an air layer interposed therebetween.

A third object of the present invention is to reduce the depth of the parametric loudspeaker to reduce on the space required for installation and, for this purpose, a reflective plate is provided along a path of travel of sound waves radiated from the ultrasonic wave radiator to change the direction of propagation of the ultrasonic wave and the audio frequency.

A fourth object of the present invention is to provide a parametric loudspeaker capable of realizing an arbitrary directivity and, for this purpose, the ultrasonic wave radiator is divided into a plurality of units and is provided with a movable mechanism so that the shape of a sound wave radiating surface can be changed, or a movable mechanism is provided so that the reflective plate can be changed.

A fifth object of the present invention is to provide a loudspeaker system for a limited listening area public address system subject to a large listening area of a capacity more than several tens of persons and, for this purpose, public address into a central region of the listening area is achieved by a use of the conventional narrow directional loudspeaker while public address into a peripheral region is achieved by the use of the parametric loudspeaker.

DETAILED DESCRIPTION OF THE INVENTION

Figure 1:
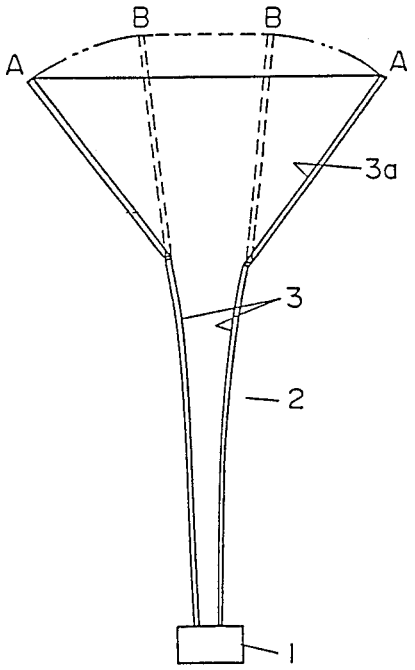
FIG. 1 PRIOR ART
FIG. 1 is a structural diagram showing a concept of a horn loudspeaker and a method for the control of the directivity of the horn loudspeaker.
Figure 2:
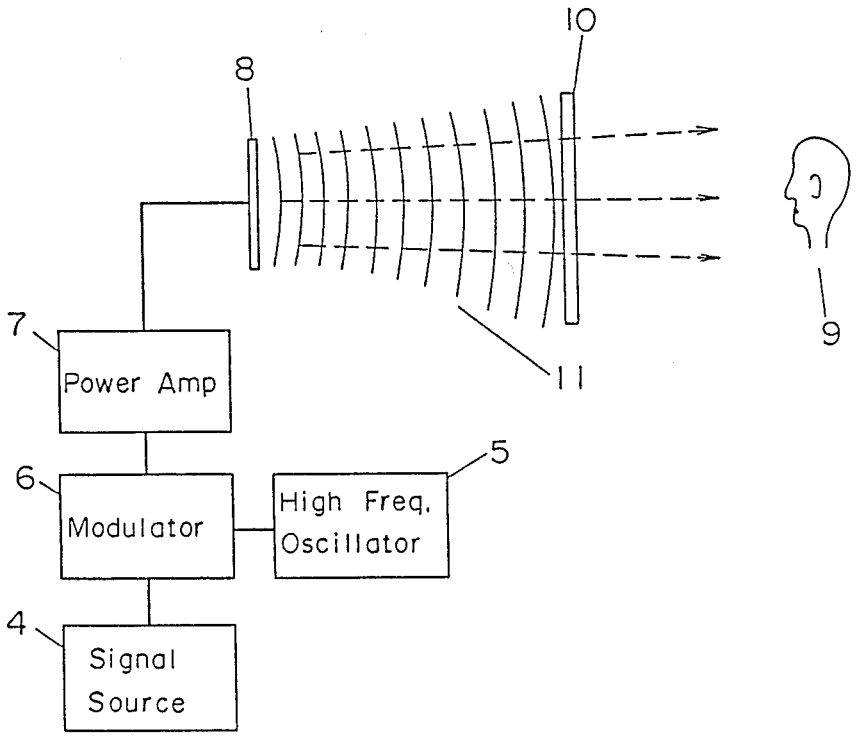
FIG. 2 PRIOR ART
FIG. 2 is a basic structural diagram of a parametric loudspeaker.
Figure 3:
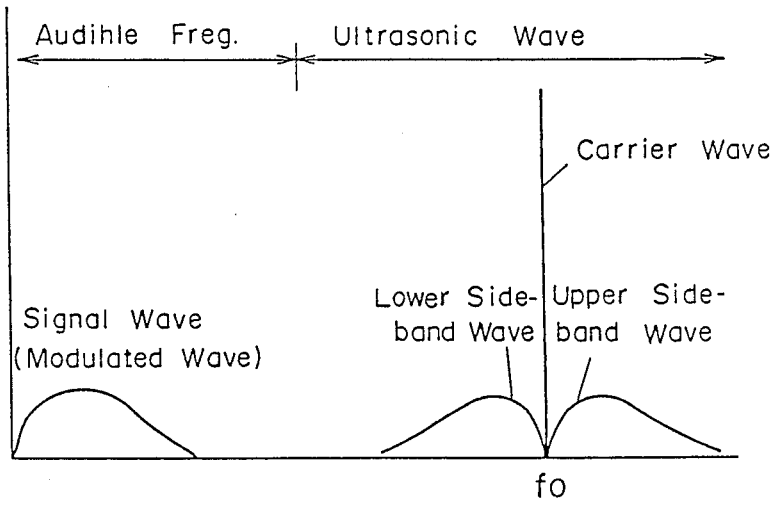
FIG. 3 PRIOR ART
FIG. 3 is a characteristic diagram showing a frequency spectrum of a sound wave radiated from the parametric loudspeaker.
Figure 4:
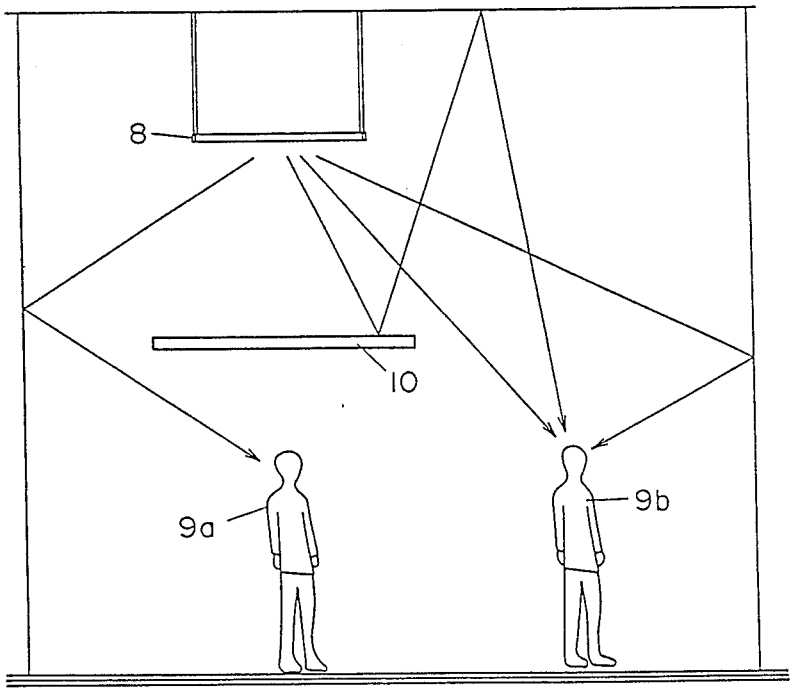
FIG. 4 PRIOR ART
FIG. 4 is a structural diagram showing the parametric loudspeaker provided with an acoustic filter and the path of travel of a primary wave in a room.
Figure 5:
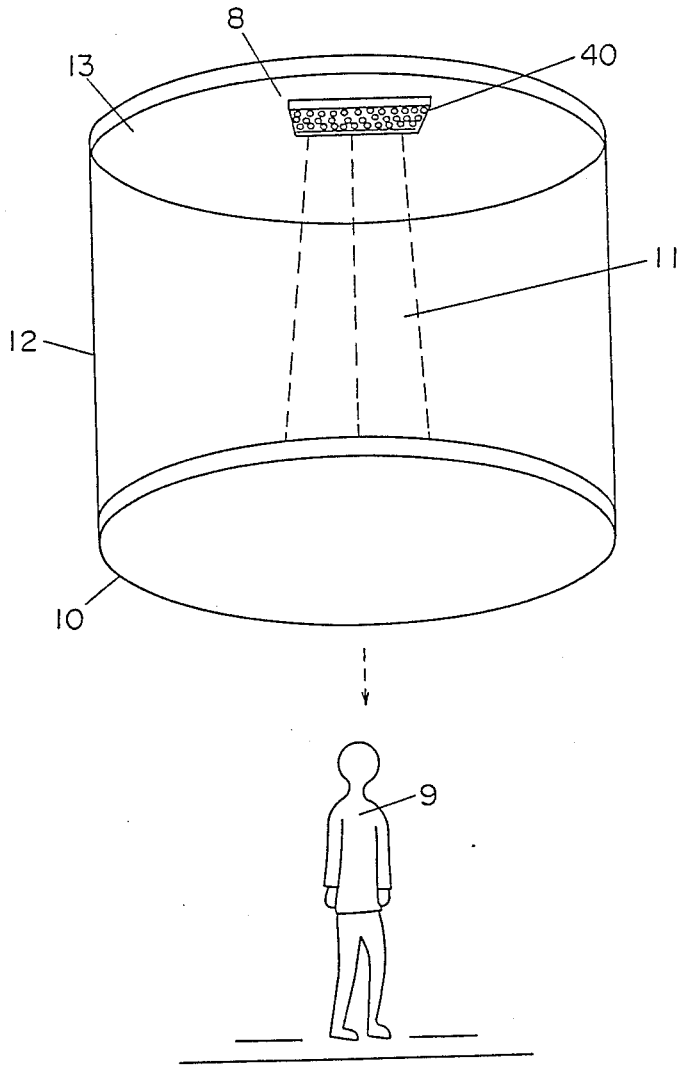
FIG. 5 is a structural diagram of the parametric loudspeaker provided with the acoustic filter and a framework for enclosing the primary wave according to a first embodiment of the present invention.

The structure of a directional loudspeaker system of a first embodiment of this invention is shown in FIG. 5.

In FIG. 5, 40 represents an ultrasonic transducer, 8 represents an ultrasonic wave radiator, 10 represents an acoustic filter, 12 represents a shield, 13 represents a baffle plate, and 9 represents a listener. Since a modulator, a power amplifier and other driving systems are the same as those explained in connection with the conventional parametric loudspeaker system, they will not be illustrated hereinafter. 11 represents a parametric array shown schematically.

The ultrasonic transducer 40 of piezoelectric vibrator type has a 9.7 mm diameter, a 40 kHz center frequency and a 123 dB sound pressure level 0.3 m above the axis at a 10 V input. The ultrasonic wave radiator 8 is comprised of 120 ultrasonic transducers 40 arranged in a honeycomb pattern on a substrate of 130×100 mm in size. The parametric array 11 is enclosed by the baffle plate 13, the shield 12 and the acoustic filter 10 to avoid any possible leakage of ultrasonic waves to the outside.

It is to be noted that the term "enclosed" need not always represent a physically enclosed condition, but may be accomplished in any manner in light of the objects of the present invention provided that the primary wave can be acoustically intercepted by the use of a structure either using a sound absorbing porous property or a maze-like sound channel effective to absorb sounds during the passage of the primary wave through the sound channel.

Figure 6:
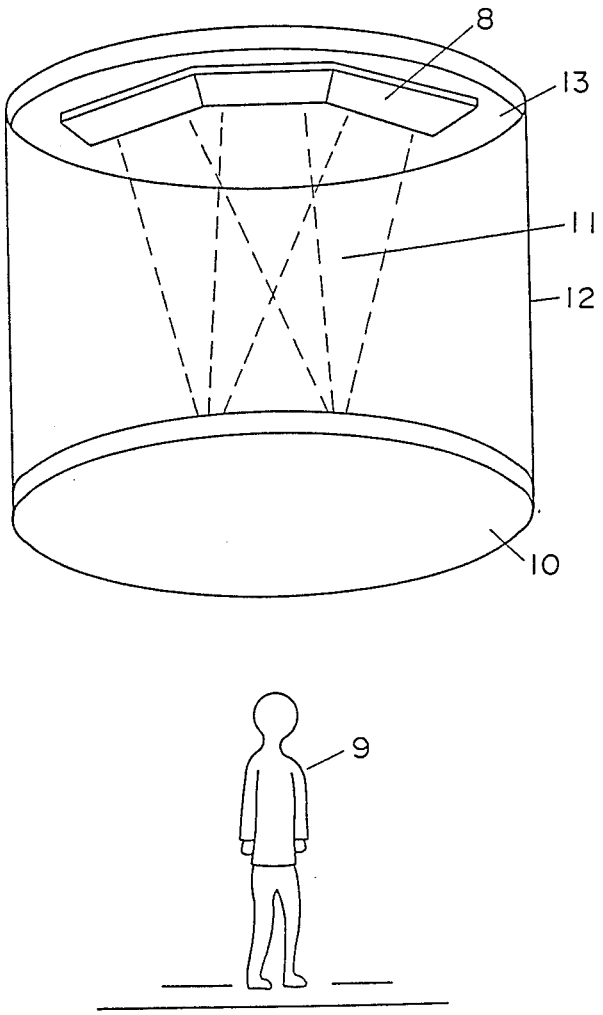
FIG. 6 is a structural diagram similar to FIG. 5 but wherein the ultrasonic wave radiator is in the form of a focusing type.

The level of the primary wave immediately below the center of the acoustic filter 10 has attained 110 dB on average and 120 dB a maximum when only the acoustic filter is employed, but attenuates 30 dB to 80 dB on average and 90 dB at a maximum after the enclosure. It is to be noted that, although the shape of the ultrasonic wave radiator 8 may be flat as shown in FIG. 5, it is possible to increase the sund pressure level at a listening point and to sharpen the directivity, as compared with a flat sound source, by imparting an angle to radiator 8 as shown in FIG. 6 or rendering it to be in the form of a spherical shell for focusing sound waves. The size of the shield 12 is as large as a sound field of the primary wave in the parametric array which will not be disturbed and is preferably 1 m or more in diameter, but the effect can be achieved with a smaller diameter.

Figure 7:
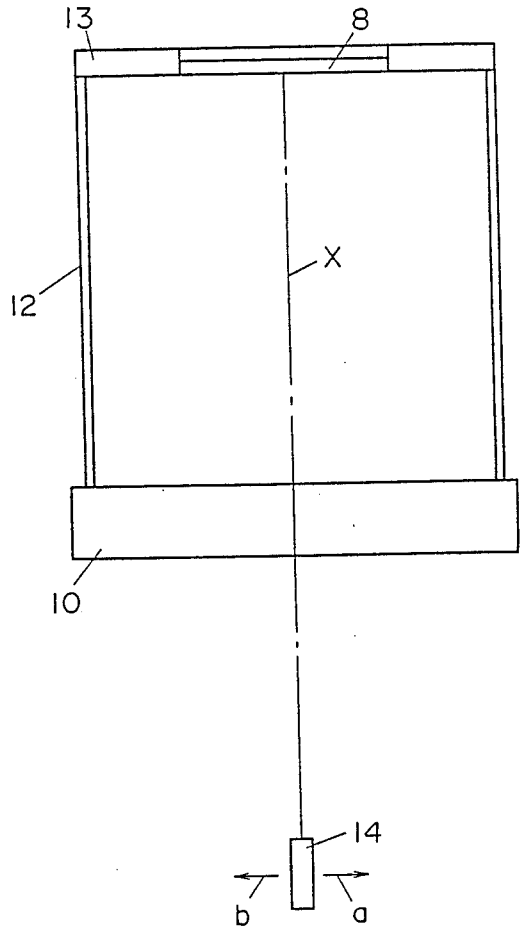
FIG. 7 is a diagram showing the acoustic filter according to a second embodiment and an arrangement of a microphone for the measurement of a characteristic of the acoustic filter.
Figure 8:
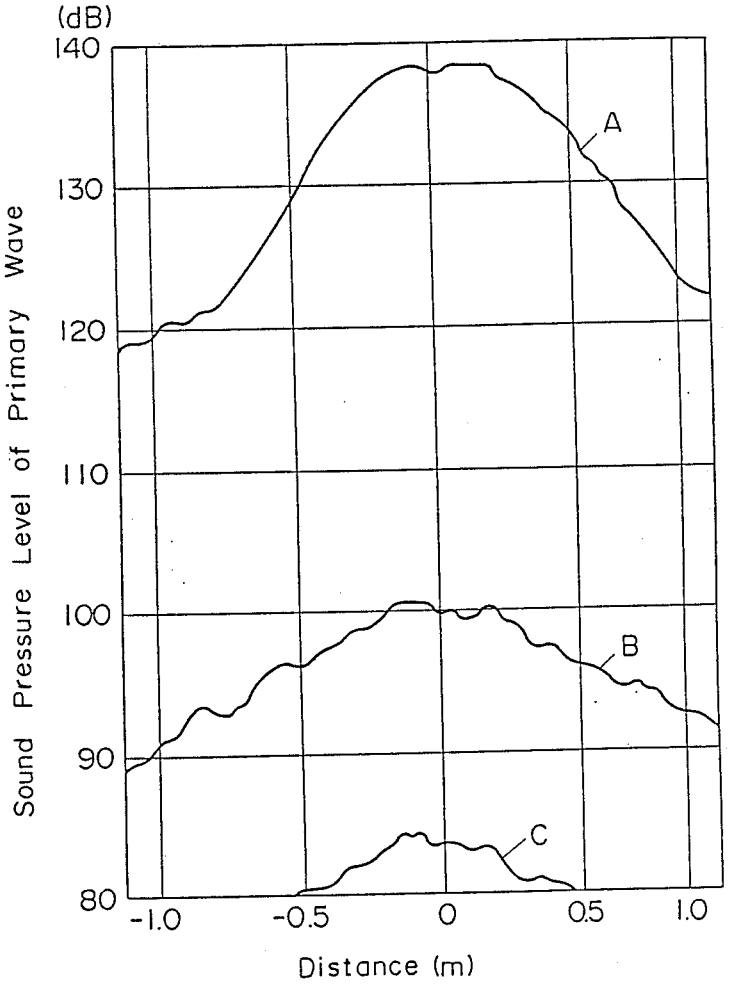
FIG. 8 is a characteristic diagram showing the sound pressure levels of the primary wave with and without the acoustic filter.
Figure 9:
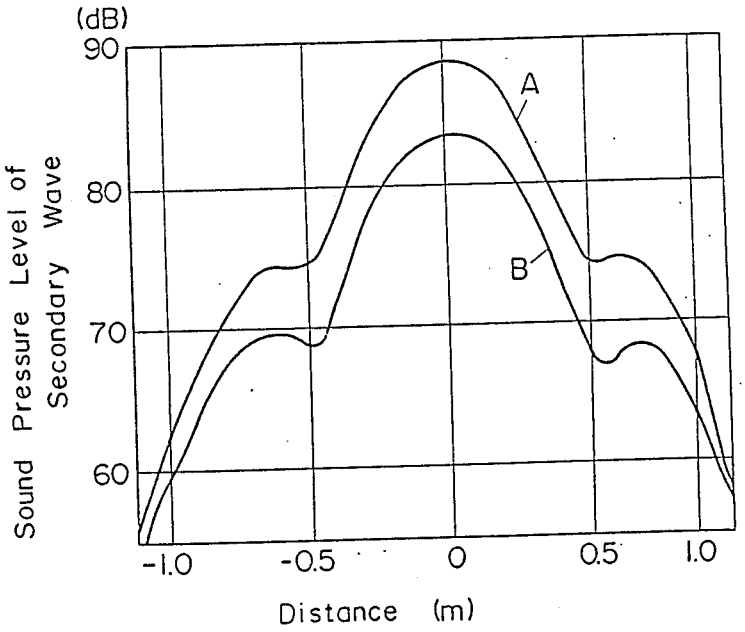
FIG. 9 is a characteristic diagram showing the sound pressure level of the secondary wave with and without the acoustic filter.

Hereinafter, the material and the structure of the acoustic filter 10 will be described with reference to other embodiments. The structure according to the second embodiment is shown in FIG. 7. 8 represents an ultrasonic wave radiator, 12 represents a frame-like shield made of acryl of 5 mm in thickness, 13 represents a baffle plate and 10 represents an acoustic filter made of soft polyurethane foam of 120 mm thickness, and the ultrasonic wave radiator 8 and the acoustic filter 10 are spaced 1.5 m from each other. 14 represents a microphone disposed at a location spaced 1 m from the acoustic filter 10. In this structure, the microphone 14 is moved parallel to the acoustic filter 10 to measure the sound pressure levels of the primary and secondary waves, the directional characteristics of which are shown in FIG. 8 and FIG. 9. FIG. 8 illustrates the directional characteristic of the primary wave and FIG. 9 illustrates the directional characteristic of the secondary wave of 1 kHz, and in FIGS. 8 and 9, A represents the characteristic without the acoustic filter 10 and the shield 12 being employed, and B represents the characteristic with both employed. It is to be noted that the axis of each abscissa represents the distance of movement from the sound wave radiating center X of the ultrasonic wave radiator, with the distance of movement in a direction indicated by the arrow a in FIG. 7 shown positive, but negative in a direction of the arrow b.

From the characteristics shown in FIGS. 8 and 9, it is clear that, while with the parametric loudspeaker in the present embodiment the primary wave is attenuated about 40 dB, the secondary wave (1 kHz) is attenuated only about 5 dB, and no change is apparent in the directional characteristic.

Figure 10:
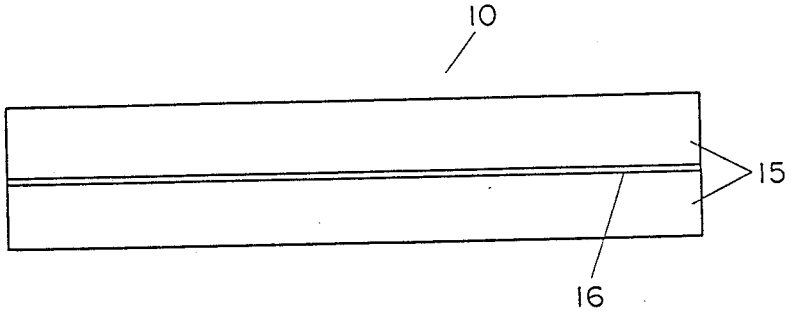
FIG. 10 is a constructional diagram showing the acoustic filter laminated in three layers of soft poly-urethane foam and polyethylene film, showing a structure according to a third embodiment.

Hereinafter, the third embodiment of the present invention will be described. In the second embodiment, since only soft polyurethane foam is used as the acoustic filter, a great thickness is necessitated. Therefore, the third embodiment provides a filter of a structure wherein a film is sandwiched between soft polyurethane foam and will be described with reference to FIG. 10.

The acoustic filter 10 was constructed by sandwiching a polyethylene film 16 of 18 μm in thickness between soft polyurethane foams 15 of 30 mm in thickness. The characteristic of this filter when measured under a condition identical with that in the second embodiment has shown that the primary wave was attenuated about 40 dB as is the case in the second embodiment, whereas the secondary wave (1 kHz) was attenuated about 3 dB and no change was apparent in the directional characteristic. That is, in the present embodiment as compared with the second embodiment, the thickness of the filter can be reduced and the attenuation of the secondary wave can be minimized.

Figure 11:
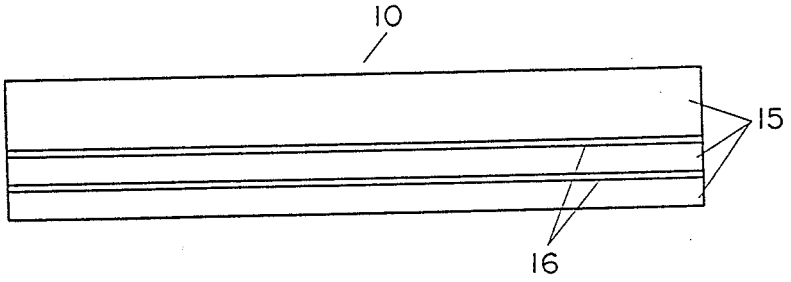
FIG. 11 is a constructional diagram of the acoustic filter laminated in five layers, showing a structure according to a fourth embodiment.

Hereinafter, the structure according to the fourth embodiment is shown in FIG. 11. By alternately laminating soft poly-urethane foams 15 of 30 mm in thickness and polyethylene films 16 of 18 μm in thickness to give a five-layered structure, the acoustic filter 10 was fabricated. The characteristic of this filter when measured under a condition identical with that in the second embodiment has shown that the level of the primary wave was attenuated about 60 dB as shown at C in FIG. 8. On the other hand, the attenuation of the secondary wave was about 6 dB.

As hereinbefore described, when the soft polyurethane foam is used alone, the thickness necessary to accomplish a required amount of attenuation of the primary wave increases and the attenuation of the secondary wave also increases. In contrast thereto, when the plastic film is sandwiched, the thickness of the filter necessary to accomplish the same amount of attenuation of the primary wave may be reduced and the attenuation of the secondary wave may be decreased correspondingly. Moreover, the material for the film may not be always limited to polyethylene and, in place of the thin plastics film, a thin paper may be used to obtain identical effects. Furthermore, with respect to the position where the film is to be sandwiched, the sandwiching at a position distant from the sound source relative to the center of the thickness would bring about enhanced effects. Yet, if a surface of the filter on the side of the sound source is a soft polyurethane foam, the frequency characteristic of the secondary wave sound pressure level can be smoothed.

Figure 12:
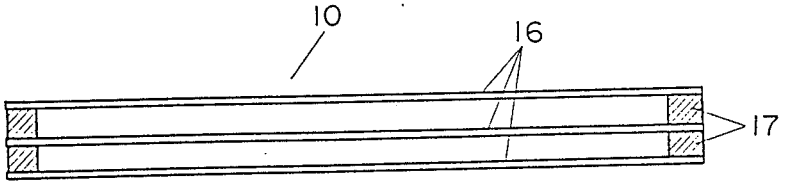
FIG. 12 is a constructional diagram of the acoustic filter laminated with polyethylene films with the intervention of air layers, showing a structure according to a fifth embodiment.

The structure of the acoustic filter used in the fifth embodiment is shown in FIG. 12. 16 represents polyethylene films of 18 μm in thickness (hereinafter referred to as films) stacked in three layers separated by spacers 17 of 1 cm in thickness. When the characteristic of this acoustic filter was measured, the second pressure level of the primary wave was attenuated about 30 dB, whereas the secondary wave was attenuated only about 2 dB, and no change was apparent in the directional characteristic.

Figure 13:
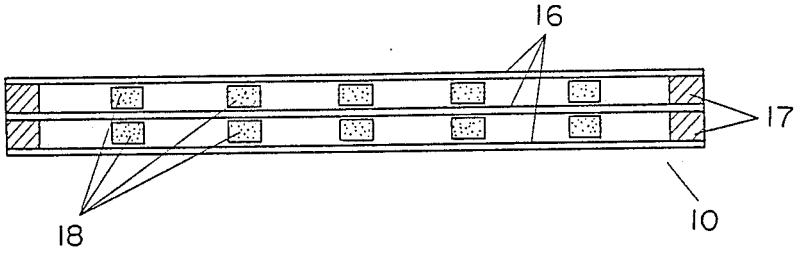
FIG. 13 is a constructional diagram of the acoustic filter provided with a grid-like spacer in an air layer portion of FIG. 12, showing a structure of a sixth embodiment.

Eventually, the shield and the acoustic filter for use in the parametric loudspeaker are required to be of such a size, for example, 1 m or more in diameter, that the sound field of the primary wave parametric array will not be distributed. In this case, it is difficult to affix the thin films 16 such as above in a predetermined spaced relationship and a central portion of one film will inevitably slacken to contact the neighbouring film. Once this happens, the secondary wave will be greatly attenuated as is the case wherein a single thick film is employed. On the other hand, although the contact may be avoided if the films 16 are affixed while stretched by the application of a predetermined tension, the result would be that the films 16 vibrate like a drum at a frequency at which a standing wave is produced and, therefore, not only is the sound quality deteriorated because of the presence of comb-like sharp irregularities in the frequency characteristic of the secondary wave sound pressure level, but also the secondary wave is attenuated because of the high sound reflectivity of the films 16. That is, it is advisable not to apply any tension to the films 16. Thus, in the sixth embodiment the acoustic filter 10 was constructed by, as shown in FIG. 13 inserting between the neighbouring films 16 second spacers 18 formed by cutting soft polyurethane foam to a grid-like shape. Although material for the grid-like spacers 18 may be wood, hard plastics or and other material, it is preferred that the material for the spacers 18 be of a type having a good sound absorbing property and low reflectivity because hard material tends to reflect the ultrasonic wave and to disturb the sound source of the secondary wave.

It is also preferred that the grid-like spacers 18 are not fixed by bonding to the films 16. Thereby, even if the films 16 are stretched horizontally, the space between the films 16 can be maintained at a constant value and the performance as the acoustic filter 10 is not lowered.

It is to be noted that, although in the present embodiment the films 16 have been shown as affixed in three layers, a different number of layers may be employed and similar effects can be obtained even though the other plastics films or papers are employed as the material of the films.

Hereinafter, a parametric loudspeaker using a reflective plate will be described with reference to further embodiments.

Figure 14:
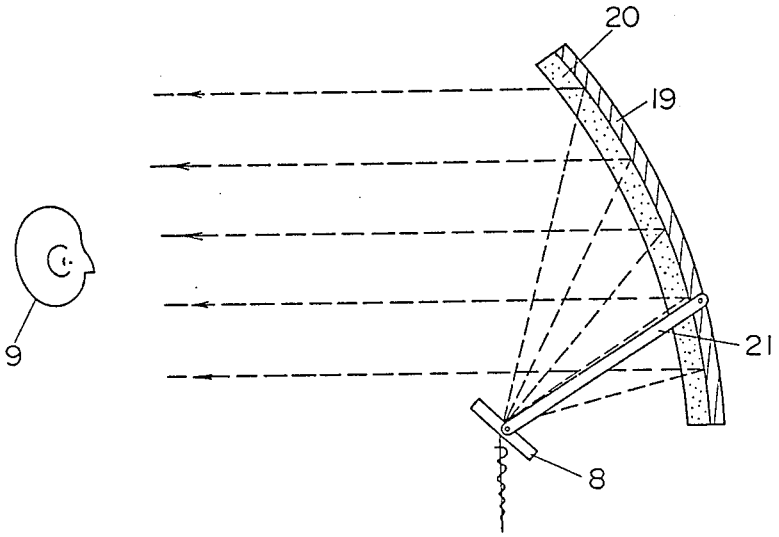
FIG. 14 is a structural diagram of the parametric loudspeaker using a reflective plate affixed with the acoustic filter, showing a seventh embodiment.

FIG. 14 illustrates the structure in the seventh embodiment of the present invention. In FIG. 14, 19 represents a reflective plate having a paraboloidal surface of 1.2 m in long diameter and made of reinforced plastic with an ultrasonic wave radiator 8 positioned at a focal point of the paraboloidal surface thereof. 21 represents a plastic arm for holding the ultrasonic wave radiator, and 20 represents an acoustic filter made of poly-urethane foam of 50 mm in thickness and bonded to a front surface of the reflective plate 19. The primary wave as well as the secondary wave, when reflected by the reflective plate, pass through the acoustic filter twice before and after the reflection, and while the second pressure level of the primary wave is greatly attenuated, the sound pressure level of the secondary wave and the directional characteristic are not substantially affected. When sound pressure levels with and without reflected waves of the acoustic filter 20, are measured, what was about 140 dB when the acoustic filter 20 was not employed was lowered 30 dB to about 110 dB when the acoustic filter 20 was installed. On the other hand, the secondary wave, comparing at a sound pressure level of 1 kHz, was about 70 dB when the acoustic filter 20 was not used, but was lowered 4 dB to about 66 dB when the acoustic filter 20 were used.

Figure 15:
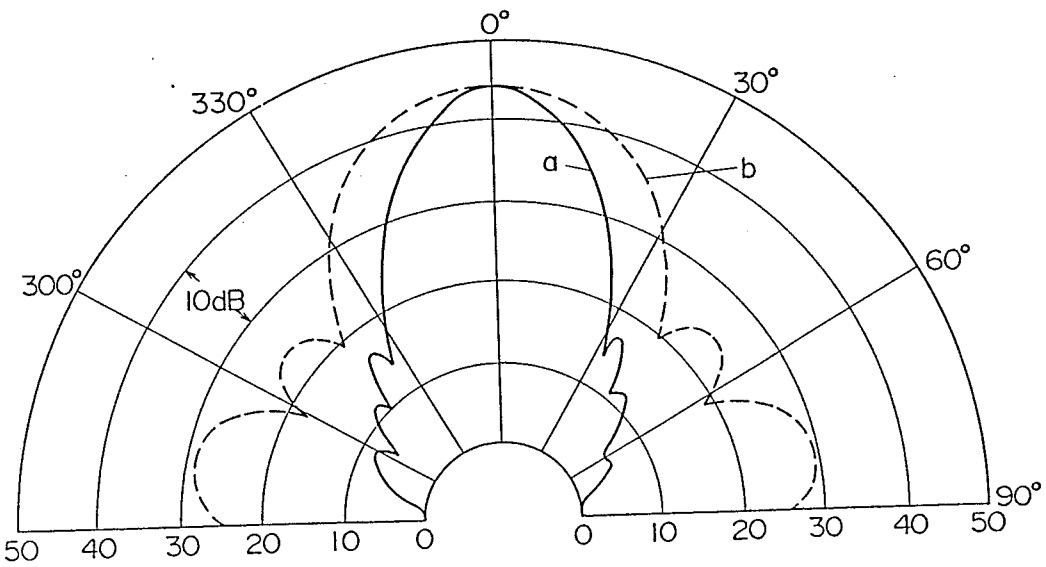
FIG. 15 is a characteristic diagram showing the difference between the directivity when the secondary wave is measured while the ultrasonic wave radiator is placed at the focal point of the reflective plate and that when a conventional loudspeaker is employed.

The directional property at a level of 1 kHz at a position spaced 2 m from the center of the reflective surface is shown in FIG. 15. In FIG. 15, the solid line a represents the directional characteristic in the case of the parametric loudspeaker of the present embodiment, and the broken line b represents the directional characteristic when the conventional piezoelectric flat loudspeaker is installed at the focal point.

As hereinbefore described, according to the present embodiment, with the structure wherein the ultrasonic wave radiator 8, the acoustic filter 20 and the reflective plate 19 are integrated together, the sound pressure level of the secondary wave can be attenuated only 4 dB whereas the primary wave can be reduced 30 dB, and a super directional characteristic with minimized side lobes as compared with the conventional loudspeakers can be obtained.

Figure 16:
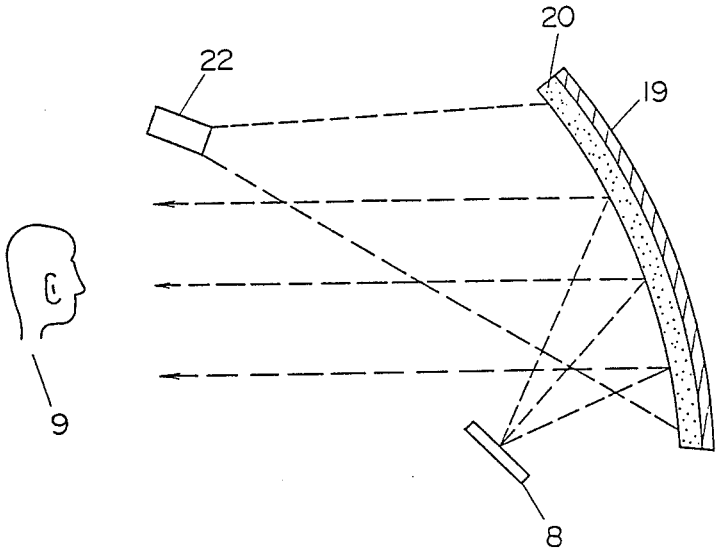
FIG. 16 is a structural diagram of the case wherein the reflective plate is concurrently used as a screen for a video projector or a movie projector.

It is to be noted that, as shown in FIG. 16, the reflective plate may be concurrently used as a screen for a movie or video projector 22 or the like, in which case the directions of pictures and sounds can be matched with each other which has hitherto been considered difficult.

Figure 17:
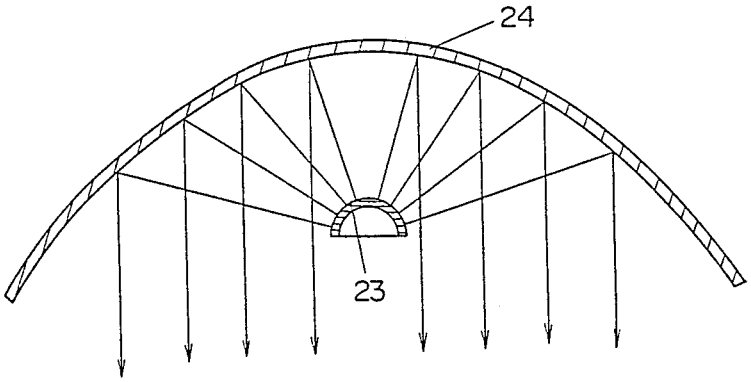
FIG. 17 is a structural diagram of the parametric loudspeaker combined with a combination of a dome-shaped ceiling and reflective a plate of a paraboloidal shape in relation to a non-directional ultrasonic wave radiator, showing a structure of an eighth embodiment.

The eighth embodiment of the present invention is shown in FIG. 17. A sound wave radiating surface of an ultrasonic wave radiator 23 is in the form of a generally spherical surface, and the directional characteristic of the secondary wave is non-directivity in the spherical space. A reflective surface 24 is in the form of a paraboloidal surface concurrently serving as a dome-shaped ceiling in a building. When the ultrasonic wave radiator is installed at the focal point of the paraboloidal surface, no change in sound pressure level occurs immediately therebelow, and the presence of the sound source is not perceived.

Figure 18:
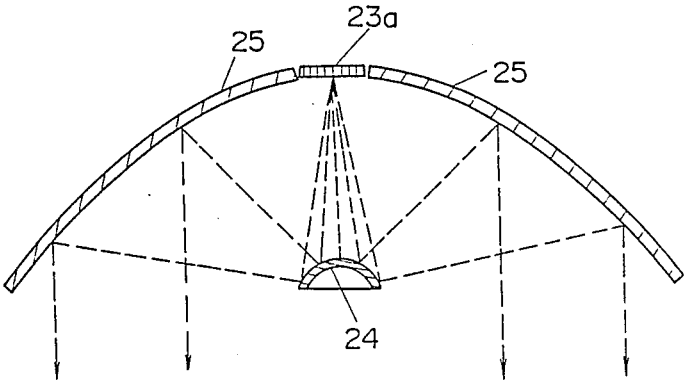
FIG. 18 is a stuctural diagram of the parametric loudspeaker wherein a generally spherical first reflective plate is disposed at the focal point of a combination of a dome-shaped ceiling and a second reflective plate of a paraboloidal shape, showing a structure of a ninth embodiment.

The ninth embodiment is shown in FIG. 18. In this embodiment, an ultrasonic wave radiator 23*a* is mounted on top of a paraboloidal reflective plate 25, and the secondary wave is, after having been reflected by a generally spherical reflective plate 24, reflected by the reflective plate 25. Effects are similar to those in the above described embodiment.

Although not shown in FIGS. 17 and 18, it is possible to permit the primary wave to be attenuated by positioning an acoustic filter on a surface of the reflective plate in a manner as shown in FIG. 16.

Figure 19:
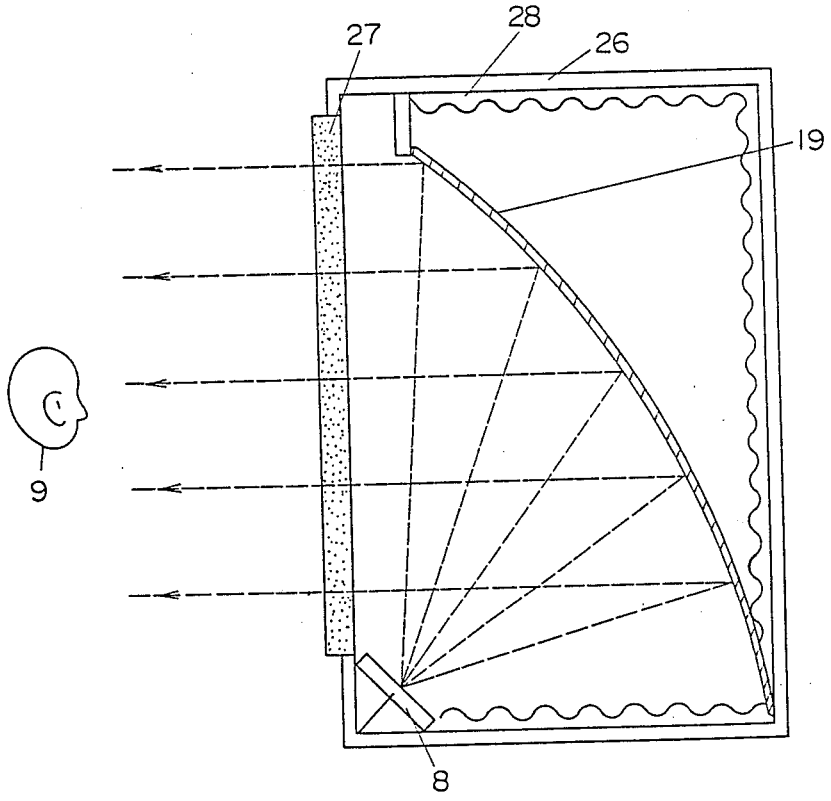
FIG. 19 is a structural diagram of the parametric loudspeaker wherein the ultrasonic wave radiator and the reflective plate are disposed within a closed box, showing a tenth embodiment.

Hereinafter, the tenth embodiment will be described with reference to FIG. 19. In FIG. 19, 19 represents a reflective plate having a paraboloidal surface, 1.2 m in length and 1 m in width, and made of aluminum. An ultrasonic wave radiator 8 is installed at a focal point of the reflective plate 19. The foregoing is similar to the structure of FIG. 14. What is different from the structure of FIG. 14 is that the ultrasonic wave radiator 8 and the reflective plate 19 are fixed within a wooden loudspeaker box 26 of 0.8 m in depth, 1.2 m in width and 1.2 m in height, and, in addition, the front of the loudspeaker box 26 is opened and fitted with an acoustic filter 27 of poly-urethane foam of 50 mm in thickness. The inner surfaces of the loudspeaker box 26 are lined with a sound absorbing material 28.

According to the foregoing structure, the acoustic filter 27 absorbs most of the primary wave and permits the passage of most of the secondary wave. Sounds (the primary wave and the secondary wave) radiated from the ultrasonic wave radiator 8 provided within the loudspeaker box 26 are reflected by the reflective plate 19 and radiated outwards through the opening of the loudspeaker box 26, but by the action of the acoustic filter 27 installed at the opening the sound pressure level of the primary wave is lowered 30 dB and the sound pressure level of the secondary wave is lowered about 3 dB. The directional characteristic of 1 kHz at a position spaced 2 m from the acoustic filter 27 is as sharp as that of the seventh embodiment.

As hereinabove described, by incorporating the ultrasonic wave radiator 8, the reflective plate 19 and the acoustic filter 27 into the loudspeaker box 26, a parametric loudspeaker of completely integrated construction is realized, and it is possible to achieve the effect that, without almost any affect on the sound pressure level of the secondary wave and the directional characteristic, the primary wave of high sound pressure level is greatly attenuated. In addition, by employing the loudspeaker box 26, the possibility can be completely avoided that the primary wave of high sound pressure level may be scattered to totally different directions is completely avoided.

Moreover, although in the seventh embodiment since the acoustic filter is fitted to the reflective plate the length of the space in which the secondary wave is produced, that is the length of the parametric array, corresponds only and the distance between the ultrasonic generator to the reflective plate, is the present embodiment, since the primary wave after having been reflected by the reflective plate participates in the formation of the secondary wave, the sound pressure level of the secondary wave increases.

Figure 20:
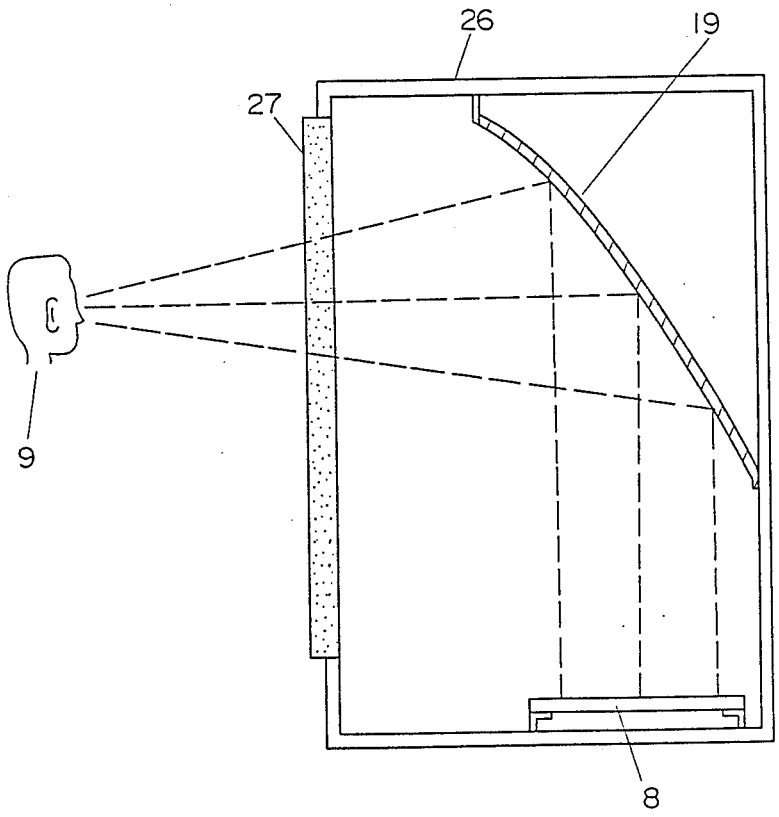
FIG. 20 is a stuctural diagram of the parametric loudspeaker wherein a spheroidal surface is employed as the reflective plate, showing an eleventh embodiment.

The eleventh embodiment of the present invention is shown in FIG. 20. In this embodiment, the reflective plate 19 has a spheroidal cross-section. The center of the ultrasonic wave radiator 8 and the point of the listener form respective focal points of the spheroid. In the present embodiment, as compared with the case wherein the paraboloidal surface is employed, the sound pressure adjacent the focal point can be sharpened. In addition, if the curved surface of a right spheroid is used, both the directivity and the sound pressure level can be further improved.

While hitherto, since the parametric loudspeaker has required a parametric array of a length ranging at least from 1 to 1.5 m with the depth of the loudspeaker consequently increased, not only is the freedom of installation limited, but the space for installation is also limited. However, with the present embodiment, since the parametric array can be oriented vertically, the loudspeaker can be placed on a floor as with a conventional loudspeaker with freedom of choice of the position of installation, and the space necessary for installation can also be decreased. In addition, by providing reflective plates at two locations as shown in FIG. 21, further compactness can be attained.

Moreover, with respect to the material for the reflective plate, in addition to reinforced plastics and aluminum, or any other general plastics, metal, glass, ceramics and wood or a compound material thereof may be employed.

Figure 21:
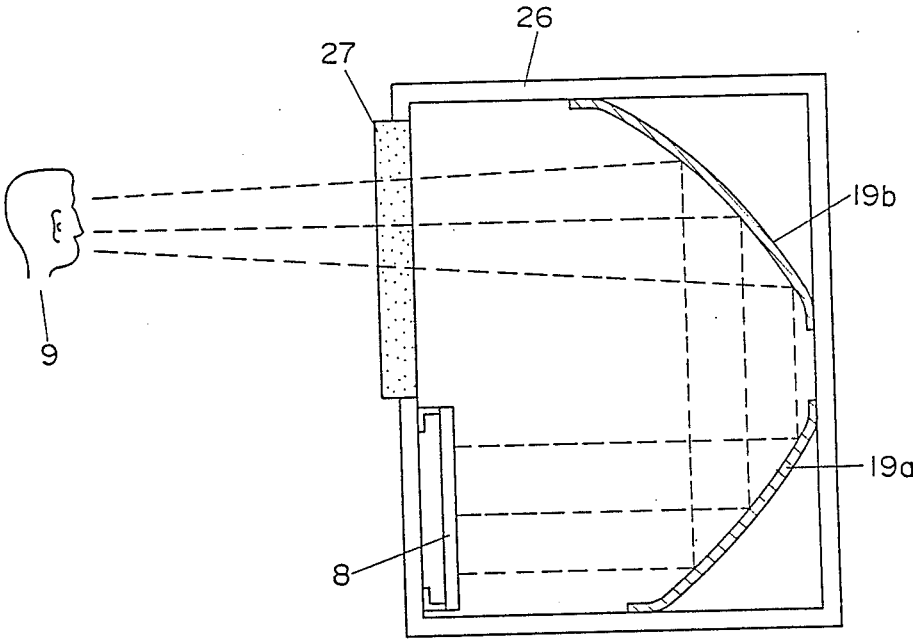
FIG. 21 is a structural diagram of the parametric loudspeaker wherein two reflective plates are used.

Furthermore, although reference has been made to the paraboloidal surface and the spheroidal surface in connection with the shape of the reflective plate, the shape need not be limited thereto, but rather the reflective plate may have a flat shape particularly where it is used in the manner shown in FIGS. 19 to 21.

Figure 22:
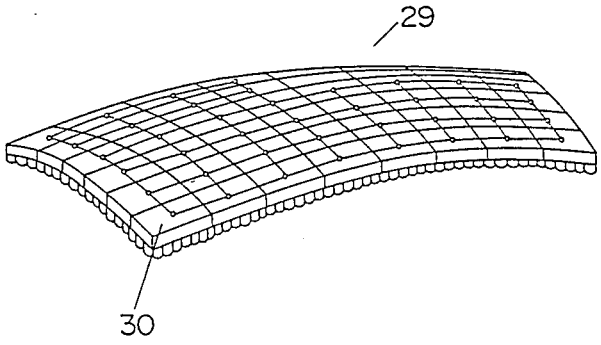
FIG. 22 is a perspective view of the ultrasonic wave radiator comprised of a plurality of units each being able to change the angle, having a concave sound wave radiating surface, and showing a twelfth embodiment.

Hereinafter, embodiments of a parametric loudspeaker the directivity of which can be controlled freely will be described. The structure of an ultrasonic wave radiator according to the twelfth embodiment is shown in FIG. 22. The ultrasonic wave radiator 29 is comprised of eight rows of six ultrasonic wave radiator units 30, totalling to 48 units, connected together while each unit is provided with an independent movable mechanism.

Figure 23:
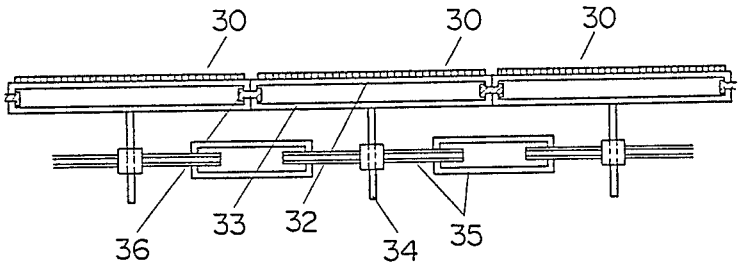
FIG. 23 is a partial plan view showing the interconnection of the units and a movable mechanism.
Figure 24:
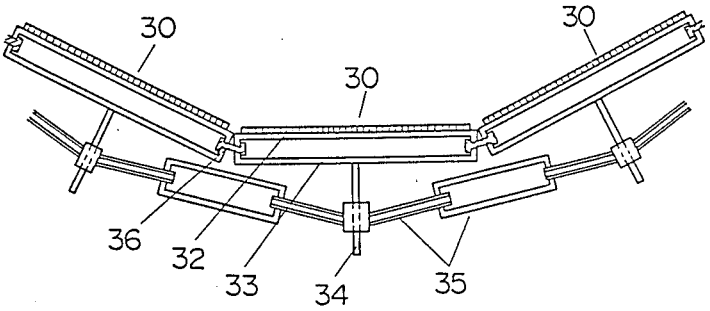
FIG. 24 is a partial plan view of the case wherein the concave sound wave radiating surface is formed by manipulating the movable mechanism.
Figure 25:
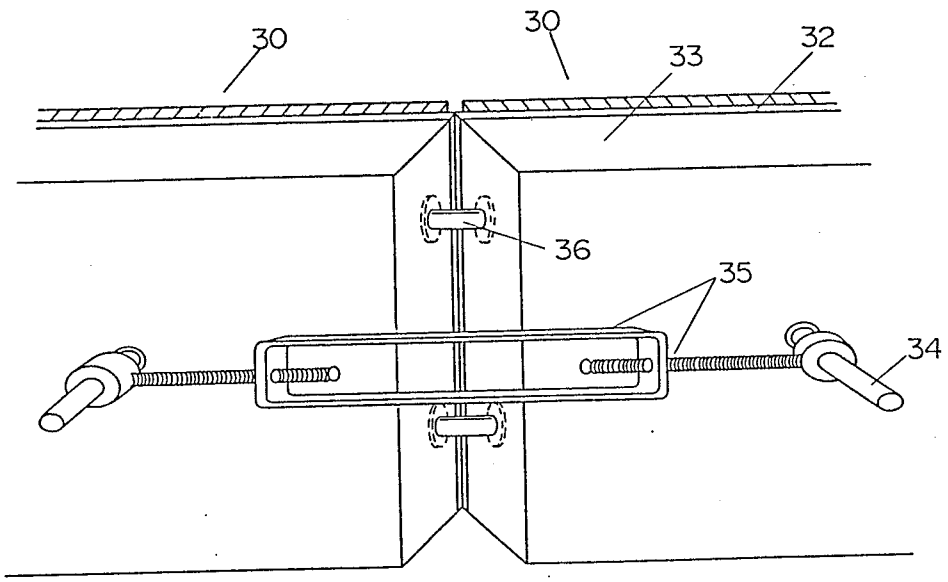
FIG. 25 is a partial perspective view of the arrangement of FIG. 24.

A partial plan view of this structure is shown in FIGS. 23 and 24, and a partial perspective view of FIG. 24 is shown in FIG. 25. In FIG. 23, frames 33 fitted to a substrate 32 have support rods 34 fixed thereto. Adjacent support rods 34 are connected together by means of respective connecting arms 35, whereas adjacent frames 33 are connected together by means of respective connecting pins 36, permitting the units to be connected together.

Each connecting arms 35 includes an intermediate portion having right-hand and left-hand threads similar to a turnbuckle, and by rotating the intermediate portion the length of arm 35 can be adjusted. Each connecting pin 36 is made of rubber and is free to elongate.

When the flat shape shown in FIG. 23 is to be changed into a concave shape as shown in FIG. 24, the total length is increased by rotating the intermediate portion of each arm 35 between adjacent connecting support rods 34. Thus, the ultrasonic wave radiator units (hereinafter referred to as units), 30 are bent, and the concave shape can be formed.

Figure 26:
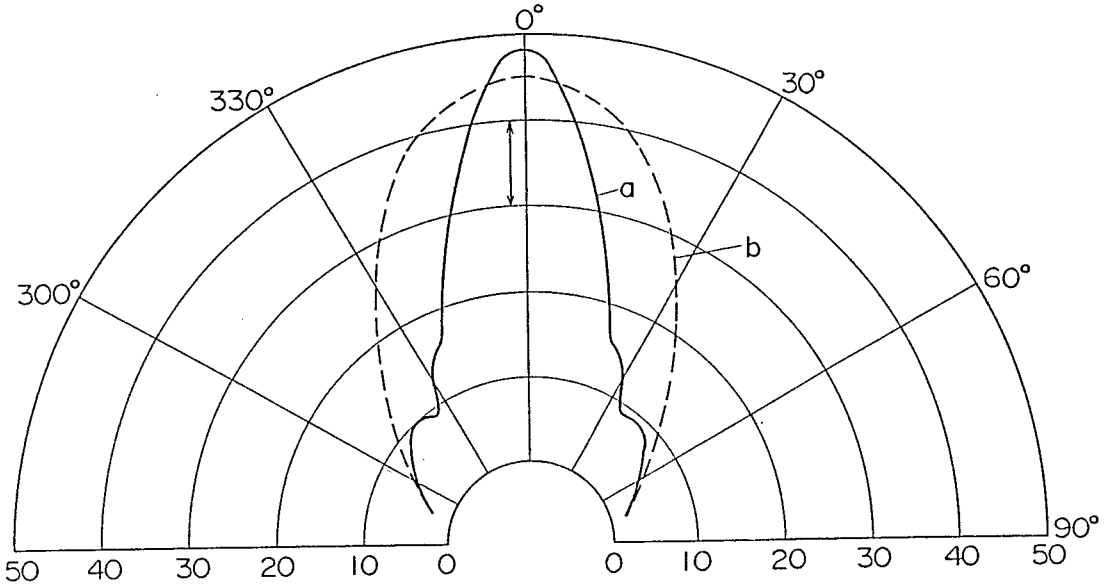
FIG. 26 is a characteristic diagram showing the difference in directivity when the sound wave radiating surface is flat and when in the form of a concave surface.

In this way, all of the 48 units 30 are adjusted into a generally arch-like concave shape so as to form a focal point. The focal length is 2 m. The frequency 1 kHz of the secondary wave of this parametric loudspeaker and the directional characteristic at a position spaced 2 m are shown by the solid line a in FIG. 26. The broken line b represents the directional characteristic of the frequency 1 kHz when all of the sound wave radiating surfaces of the 48 units are arranged to provide a flat ultrasonic generator. When comparison is made to the angle at which the sound pressure level exhibits −10 dB compared with that on the axis, it is 20° when the sound wave radiating surface of the ultrasonic wave radiator 20 is flat whereas it is about 8° when the sound wave radiating surface is a generally arch-like concave shape having a focal length of 2 m.

As hereinafter described, according to the present embodiment, as compared with the ultrasonic wave radiator wherein the sound wave radiating surface is flat, the directional characteristic of the secondary wave can be further sharpened and the listening range can be narrowed because of the fact that the generally arch-like concave ultrasonic wave radiator 29 is formed by adjusting the individual angles of the units 30 so that the sound wave radiating surface of the ultrasonic wave radiator 29 can have a focus. In this case, an additional effect can be obtained in that the sound pressure level on the axis can be improved.

Figure 27:
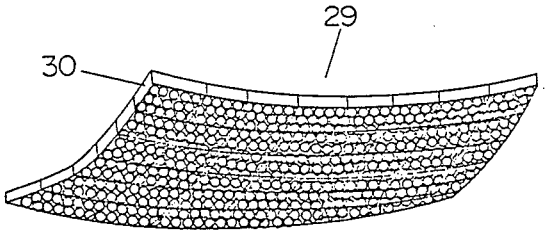
FIG. 27 is a perspective view of the case wherein a convex sound wave radiating surface is formed, showing a thirteenth embodiment.
Figure 28:
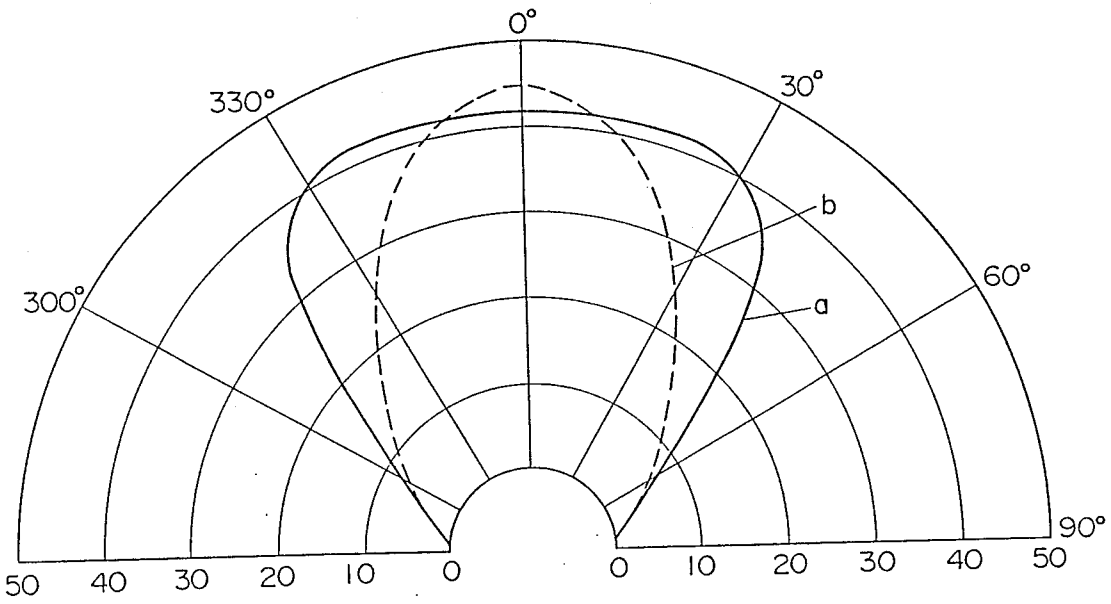
FIG. 28 is a characteristic diagram showing the difference in directivity when the sound wave radiating surface is flat and when in the form of a convex surface.

With reference to FIG. 27, the thirteenth embodiment will be described. This embodiment differs from the structure of FIG. 22 in that the units 30 are so arranged as to render the sound wave radiating surface of the ultrasonic wave radiator 29 to be a generally arch-like convex shape. The directional characteristic of the frequency 1 kHz of the secondary wave of this parametric loudspeaker is shown by the solid line a in FIG. 28. The broken line b represents the directional characteristic of the frequency 1 kHz obtained when, as explained in connection with the twelfth embodiment, all of the sound wave radiating surfaces of the 48 units 30 are arranged flat. When comparison is made to the angle at which the sound pressure level exhibits −10 dB compared with that on the axis, it is 20° with the flat ultrasonic wave radiator, but the ultrasonic wave radiator arranged generally in a convex arch-like shape exhibits 40° even though the sound pressure level is somewhat reduced, indicating that the listening range is doubled. In this case, in view of the fact that the sound wave radiating surface is a convex arch-like shape, peripheral units of the ultrasonic wave radiator no longer participate in the sound pressure on the center axis and, therefore, the primary wave is diffused with the directional characteristic enlarged. It can be readily understood that the secondary wave of the parametric loudspeaker depends on the shape of a main lobe of the primary wave.

As hereinbefore described, as compared with the case wherein the sound wave radiating surface is flat, by selecting the angle of the units 30 such that the sound wave radiating surface can be of a generally arch-like convex shape, the directional characteristic of the secondary wave becomes flat within a particular range and, when deviating from this range, abruptly attenuates and, therefore, it is possible to expand the listening area.

With respect to displacement of a listening point which tends to occur when the listening area is extremely narrowed such as in the twelfth embodiment, this can readily be corrected in view of the fact that the sound wave radiating surface of the units 30 are individually adjustable.

Although in this embodiment the sound wave radiating surface of the ultrasonic wave radiator 29 has a generally arch-like shape, the cross-section may have any suitable shape.

In addition, although the units 30 have been described as connected angularly adjustably by means of the frames and the support and connecting rods fitted to the substrates, any other method of adjustability may be employed.

Figure 29:
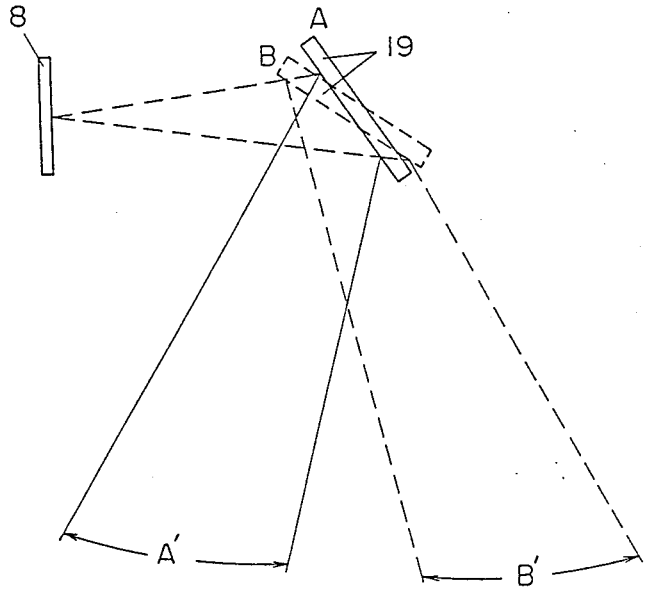
FIG. 29 is a structural diagram of the parametric loudspeaker wherein the reflective plate is provided with a rotary mechanism, showing a fourteenth embodiment.

Eventually, where the directional characteristic is to be controlled according to the above described method, it becomes necessary to move the entire units provided with many ultrasonic transducers and, therefore, not only is the mechanism complicated, but also the space for installation is limited. In contrast thereto, if the reflective plate described in connection with the seventh to eleventh embodiments is used and the angle or shape of the reflective plate is adjusted, the mechanism will be simple and the limitation on the space for installation will be removed. Embodiments of this method will now be described. The fourteenth embodiment is shown in FIG. 29. Sounds radiated from the ultrasonic wave radiator 8 are allowed to be reflected by the reflective plate 19 made of aluminum. The angle of the reflective plate can be adjustable When the reflective plate is held at, a portion A' the listening area is A', but when at a position B, the listening area is B'. Where the listening area is fixed, the reflective plate has to be fixed at a predetermined angle.

Figure 30:
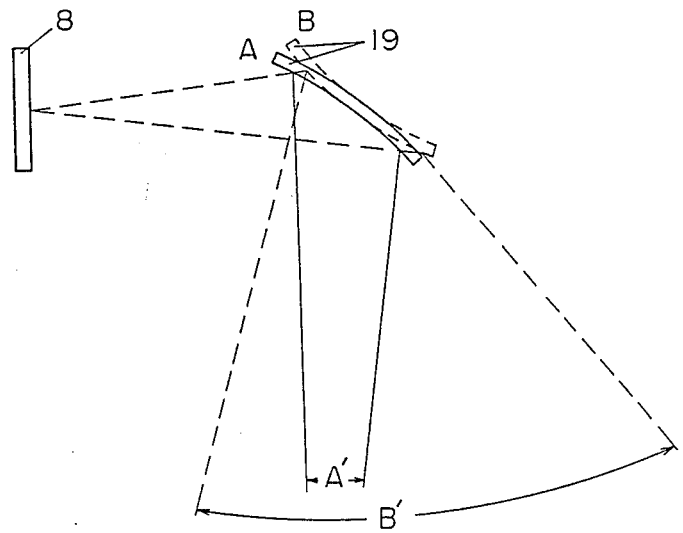
FIG. 30 is a structural diagram of the parametric loudspeaker capable of being changed between a concave surface and a convex surface, showing a fifteenth embodiment.

The fifteenth embodiment is shown in FIG. 30. In this case, the reflective plate 19 has a curved surface, the curvature of which is variable. When the reflective plate has a concave surface as shown by A, the listening area is shown by A' and sounds can be converged. Conversely, when the reflective plate has a convex surface as shown by B, the listening area is shown by B' and sounds can be diverged.

Although not shown, it is quite natural that the primary wave can be intercepted to safeguard listeners by providing the surface of the reflective plate with the acoustic filter as has been described previously or by positioning the ultrasonic wave radiator and the reflective plate within a framework as has been described above.

Although the parametric loudspeaker is suited for public address into a limited listening area since it has a sharp directivity, which is not provided in the prior art, the use of a very bulky ultrasonic wave radiator is required for public address into a large listening area and is disadvantageous in terms of cost and energy consumption. Therefore, in order to secure a sufficient sound volume at the center of the listening area, a method can be contemplated wherein a narrow-directional loudspeaker such as a hitherto used horn loudspeaker is employed and the parametric loudspeaker is employed only to secure a sound volume at a peripheral portion and for the purpose of sharpening a change in sound pressure level at the end of the listening area. Emodiments of this method will be hereinafter described.

Figure 31:
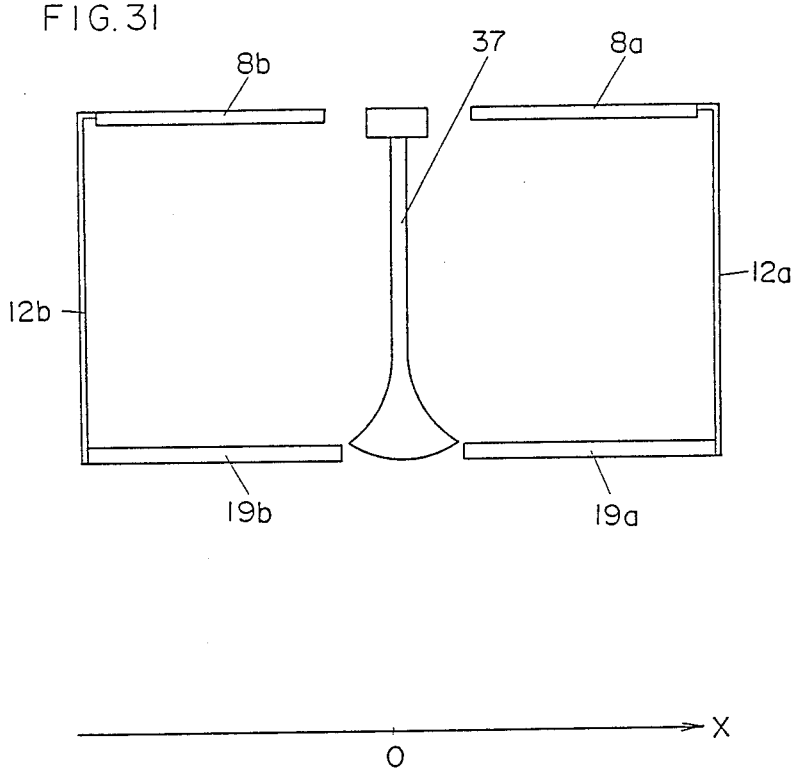
FIG. 31 is a plan view showing the structure of a directional loudspeaker wherein the parametric loudspeaker and the conventional loudspeaker are combined together, showing a sixteenth embodiment.
Figure 32:
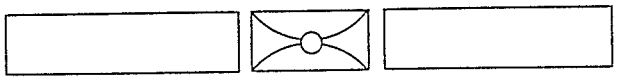
FIG. 32 is a front view of the arrangement of FIG. 31.
Figure 33:
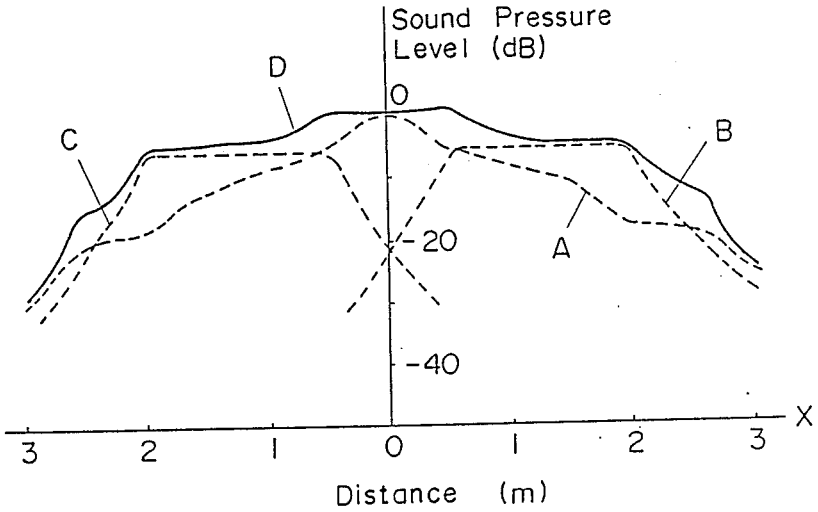
FIG. 33 is a characteristic diagram showing a directional characteristic of the directional loudspeaker shown in FIG. 31.

The structure according to the sixteenth embodiment is shown in FIGS. 31 and 32. 37 represents a horn loudspeaker of 1.5 m in length, and parametric loudspeakers are arranged on respective sides thereof. 8*a* and 8*b* represent ultrasonic wave radiators, and 19*a* and 19*b* represent acoustic filters. 12*a* and 12*b* represent framework for preventing ultrasonic waves from leaking in leftward and rightward directions. The ultrasonic wave radiators and the acoustic filters are spaced 1.5 m from each other and, when viewed from front, the three loudspeakers lie in the same plane. When a distribution of sound pressure in a horizontal direction (x-axis direction) was measured at a position spaced 1.5 m from the loudspeaker front by driving each loudspeaker, it was as shown in FIG. 33. A represents only the horn loudspeaker, B and C represent use of only one of the respective parametric loudspeakers, and D represents when the both were driven. While the change in sound pressure of the horn loudspeaker is moderate, the parametric loudspeakers are completely uniform at the front of the ultrasonic wave radiators and abruptly reduce when displaced from the end. As a result, a sufficient sound volume is secured adjacent the axis by the horn loudspeaker and, at location distant therefrom, reduction in sound pressure of the horn loudspeaker is compensated for by the parametric loudspeakers. At the end of the listening area, an abrupt reduction in sound pressure is observed, reflecting the characteristics of the parametric loudspeakers. At a further location distant therefrom, the sound volume resulting from the horn loudspeaker increases again, but there is no problem because the sound pressure at this point is reduced more than 20 dB as compared with the central area.

Although in the present embodiment only one horn loudspeaker has been described as used at the center, a plurality of horn loudspeakers may be employed where the listening area is large.

Figure 34:
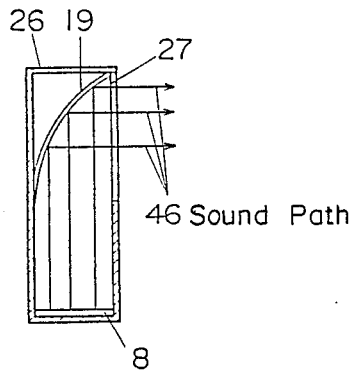
FIG. 34 is a sectional view showing the structure of the directional loudspeaker wherein in FIG. 31 a horn loudspeaker of is direct radiator type is employed and the parametric loudspeaker is of a system employing a reflective plate, showing a seventeenth embodiment.
Figure 35:
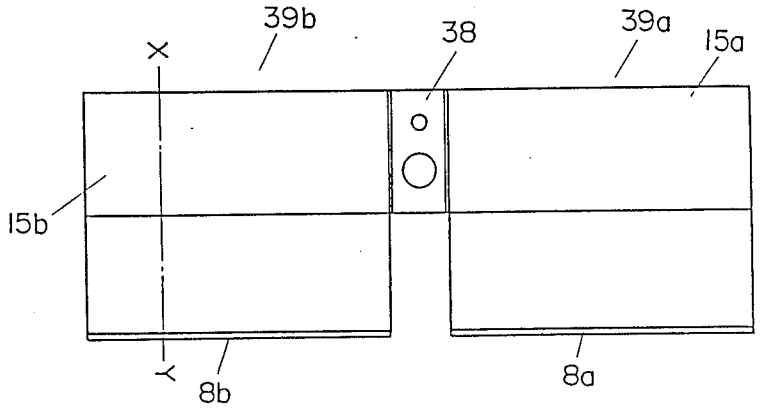
FIG. 35 is a front view of the arrangement of FIG. 34.

The structure according to the seventeenth embodiment is shown in FIGS. 34 and 35. 38 represents a direct radiator-type loudspeaker hitherto used, and parametric loudspeakers 39*a* and 39*b* and acoustic filters 15*a* and 15*b* are arranged on respective sides thereof. The parametric loudspeakers employed are, unlike the sixteenth embodiment, as described with reference to FIG. 19. Although in the sixteenth embodiment the space for installation is limited because a depth of 1.5 m or greater is required, the present embodiment can be installed in the same way as the conventional loudspeaker device because the depth may suffice to be a few tens of centimeters.

It is to be noted that 46 represents the path of travel of sound waves from the ultrasonic wave radiator 8 and that FIG. 34 is a cross-sectional view taken along the line X—X in FIG. 35.

INDUSTRIAL APPLICABILITY

As hereinbefore explained, by enclosing the space necessary to produce the audio frequency from the ultrasonic wave with the framework to avoid any leakage of the ultrasonic wave and by providing at least a portion of the framework with the acoustic filter capable of passing only the audio frequency, this invention is effective to intercept the powerful ultrasonic wave radiated from the ultrasonic wave radiator thereby to safeguard the listeners.

In addition, by laminating soft foamed poly-urethane and thin plastics film or spacing a plurality of thin plastics films with the intervention of an air layer, the structure and the material suited for the acoustic filter can be provided.

Moreover, by providing the reflective plate on the path of travel of sound radiated from the ultrasonic wave radiator to vary the direction of propagation of the ultrasonic wave and the audio frequency, the depth of the parametric loudspeaker can be reduced with the limitation on the space of installation consequently removed.

Further, either by dividing the ultrasonic wave radiator into a plurality of units and providing the ultrasonic wave radiator with the movable mechanism so that the shape of the sound wave radiating surface can be changed, or by providing the reflective plate with the movable mechanism so that the position and shape of the reflective plate can be changed, the parametric loudspeaker capable of realizing the arbitrary directivity can be provided.

Furthermore, by using the conventional narrow-directional loudspeaker for the public address into the central region of the listening area and the parametric loudspeaker for the public address into the peripheral region, the limited listening area public address system subject to the large listening area of a capacity of accommodating more than several tens of persons can be provided.

We claim:

1. A directional loudspeaker system comprising:

an enclosure means for surrounding a respective space defined therein and in which a medium is disposed;

ultrasonic wave radiator means directed toward the space within said enclosure means for generating as a primay wave a finite amplitude ultrasonic wave modulated by an audible sound through the medium which produces a secondary wave at a frequency at which the secondary wave is audible; and the enclosure means comprising a shield portion for preventing said primary wave from propagating through the enclosure means and out of said space and an acoustic filter means portion for allowing only said secondary wave to propagate through the enclosure means and out of said space.

2. A system as claimed in claim 1, wherein said acoustic filter means is formed of soft foamed polyurethane material.

3. A system as claimed in claim 1, wherein said acoustic filter means comprises at least one layer of soft foamed polyurethane laminated with at least one layer of paper or plastic film, and one surface of said acoustic filter means adjacent said ultrasonic wave radiator means is soft foamed polyurethane.

4. A system as claimed in claim 1, wherein said acoustic filter means comprises a stack of paper sheets or plastic films spaced from each other by a predetermined distance.

5. A system as claimed in claim 4, further comprising a generally grid-like spacer having a predetermined thickness equal to said predetermined spacing and positioned between adjacent said paper sheets or plastic films to avoid any possible contact between adjacent said paper sheets or plastic films.

6. A system as claimed in claim 5, wherein said grid-like spacer is made of a material capable of permitting the passage therethrough of said secondary wave.

7. A system as claimed in claim 1, further comprising a reflective plate positioned in said space within said enclosure means for reflecting said primary and secondary waves.

8. A system as claimed in claim 7, wherein said reflective plate includes a wave reflecting surface comprising a portion of a concave paraboloidal surface or a right spheroidal surface, and said ultrasonic wave radiator means is positioned at a focal point of said concave paraboloidal surface or said right spheroidal surface.

9. A system as claimed in claim 7, wherein said reflective plate includes a wave reflecting surface of a concave shape and a cross-section forming part of a paraboloid or a spheroid, and said ultrasonic wave radiator is positioned at a focal point thereof.

10. A system as claimed in claim 1, wherein said ultrasonic wave radiator means comprises a plurality of individual units together defining a sound radiating surface, and further comprising means for moving said units relative to each other to thereby vary the shape of said sound radiating surface.

11. A directional loudspeaker system comprising:

ultrasonic wave radiator means for generating as a primary wave an ultrasonic wave modulated by an audible sound and a secondary wave;

at least one reflective plate positioned for reflecting said primary and secondary waves;

at least one surface of said reflective plate provided with acoustic filter means for intercepting said primary wave and permitting the passage of said secondary wave; and a support means for supporting said reflective plate in a position with respect to said ultrasonic wave radiator means at which said plate reflects said primary and said secondary waves generated by said ultrasonic wave radiator means.

12. A system as claimed in claim 11, wherein said reflective plate includes a wave reflecting surface of a concave shape and a cross-section forming part of a paraboloid or a spheroid, and said ultrasonic wave radiator means is positioned at a focal point thereof.

13. A system as claimed in claim 11, further comprising means for changing at least one of the position or the shape of said reflective plate.

14. A system as claimed in claim 13, wherein said changing means comprises a rotary mechanism for rotating said reflective plate.

15. A system as claimed in claim 13, wherein said changing means comprises means for reversibly adjusting the shape of a reflecting surface of said reflecting plate to be concave or convex.

16. A directional loudspeaker system comprising:

first loudspeaker means for directing public address primarily to a central portion of a particular listening area;

second loudspeaker means for directing public address primarily to a peripheral portion of the listening area, said second loudspeaker means comprising a parametric loudspeaker for producing a secondary sound wave at an audible frequency from a primary wave in the form of a finite amplitude ultrasonic wave modulated by an audible sound, and support means for supporting said first loudspeaker means in a position at which said first loudspeaker means directs the public address in a first direction extending toward said central portion and for supporting said second loudspeaker means in a position at which said second loudspeaker means directs public address in a second direction adjacent said first direction, the second direction extending toward said peripheral portion.

17. A system as claimed in claim 16, wherein said first loudspeaker means comprises a horn loudspeaker.

18. A directional loudspeaker system comprising:

ultrasonic wave radiator means for generating as a primary wave an ultrasonic wave modulated by an audible sound through a nonlinear medium wherein a secondary wave at an audible frequency is produced;

at least one reflective plate positioned for reflecting said primary and secondary waves;

said ultrasonic wave radiator means and said reflective plate being positioned within the interior of an enclosure means for enclosing said primary wave within said interior and for preventing leakage of said primary wave therefrom;

acoustic filter means provided at at least a portion of said enclosure means for permitting the passage of said secondary wave from said interior; and means for changing at least one of the position or the shape of said reflective plate.

19. A system as claimed in claim 18, wherein said changing means comprises a rotary mechanism for rotating said reflective plate.

20. A system as claimed in claim 18, wherein said changing means comprises means for reversibly adjusting the shape of a reflecting surface of said reflecting plate to be concave or convex.

21. A directional loudspeaker system comprising:

ultrasonic wave radiator means for generating as a primary wave an ultrasonic wave through a nonlinear medium wherein a secondary wave at an audible frequency is produced, said ultrasonic wave radiator means comprising a plurality of individual units operatively connected together, each of said units including a radiating plate for radiating said primary and said secondary waves generated, said radiating plates of said units collectively defining a wave radiating surface at which said first and said second waves are radiated; and means operatively connected to each of said units for changing a shape of said wave radiating surface defined by said radiating plates of said units.

* * * * *